US009005086B1

(12) United States Patent
O'Neil

(10) Patent No.: US 9,005,086 B1
(45) Date of Patent: Apr. 14, 2015

(54) PORTABLE ROWING MACHINE

(71) Applicant: John J. O'Neil, Palm Harbor, FL (US)

(72) Inventor: John J. O'Neil, Palm Harbor, FL (US)

(73) Assignee: Douglas L. Hermann, Clearwater, FL (US)

( * ) Notice: Subject to any disclaimer, the term of this patent is extended or adjusted under 35 U.S.C. 154(b) by 36 days.

(21) Appl. No.: 14/012,306

(22) Filed: Aug. 28, 2013

(51) Int. Cl.
*A63B 21/00* (2006.01)
*A63B 22/00* (2006.01)

(52) U.S. Cl.
CPC ..... *A63B 22/0076* (2013.01)

(58) Field of Classification Search
None
See application file for complete search history.

(56) References Cited

U.S. PATENT DOCUMENTS 335,597 A * 2/1886 Iibbey ..... 482/72
413,015 A 10/1889 Bigger
1,111,269 A 9/1914 Medart
3,528,653 A 9/1970 Stuckenschneider et al.
4,563,000 A * 1/1986 Gall ..... 482/72
4,650,171 A * 3/1987 Howorth ..... 5/600
5,441,469 A * 8/1995 Chern ..... 482/72

* cited by examiner

*Primary Examiner* — Jerome w Donnelly
(74) *Attorney, Agent, or Firm* — Kyle S. Brant

(57) ABSTRACT

A portable rowing machine is disclosed that includes a tubular frame consisting of two parallel tubes positioned and supported by floor brackets, a seat that is removably situated on top of the tubular frame and slidable along the tubular frame on rollers mounted to the underside of the seat, swivel arms attached to brackets and extending perpendicularly outward from the tubular frame, and oar arms attached to the ends of the swivel arms. The tubular frame includes a telescoping portion enabling adjustment of the length of the frame from a compact storage size to a size desired for a users leg length. The swivel arm brackets are pivotally positionable in a storage position and a working position. The oar arms are adjustable in length to suit the users body size. A clutch bearing and band brake assembly provides oar arm motion resistance comparable to rowing a boat.

16 Claims, 11 Drawing Sheets

PORTABLE ROWING MACHINE

FIELD OF THE INVENTION

The present invention relates in general to exercise machines and more particularly to a portable rowing machine.

BACKGROUND OF THE INVENTION

Many variations on exercise machines are well known in the prior art. One particular type of exercise machine that remains very popular is the rowing machine. Generally, rowing machines include a frame upon which a seat is slidably engaged, foot rests at one end of the frame and rowing arms attached to the frame extending out to the side and providing resistance to movement in one direction to simulate the rowing motion developed when one rows a small boat.

Rowing machines provide a rigorous workout since the arm, back and leg muscles must be used to overcome the resistance presented by a rowing machine. In addition, abdominal muscles receive a good workout when rowing takes place.

Some of the drawbacks of rowing machines known in the prior art include excessive weight, bulkiness and designs that are not readily folded up or collapsed to reduce the size of the machine (height, width and length) for easy storage thereof.

Thus, what is needed is a rowing machine that provides all of the exercise features of rowing a boat that is a rugged and sturdy design yet readily collapsible and folded up for convenient storing of the rowing machine when not in use.

SUMMARY OF THE INVENTION

A portable rowing machine, according to one aspect of the present invention, comprises a frame including a first tube having a first end and a second end, a second tube having a first end and a second end, a first support bracket attached to said first tube and said second tube near said first end of said first and second tubes, and a second support bracket attached to said first tube and said second tube at a location between said first end and said second end of said first tube and said second tube and spaced apart from said first support bracket, said first support bracket and said second support bracket maintaining said first tube and said second tube in a horizontal parallel relationship at a first predetermined distance, an arm bracket attached to said first tube and said second tube at a location between said first and said second support brackets, a first arm having a proximal end and a distal end and attached to said arm bracket at the proximal end of said first arm and extending substantially perpendicularly outward from said first tube, said first arm including a first hinge attached to the distal end of said first arm, a second arm having a proximal end and a distal end and attached to said arm bracket at the proximal end of said second swivel arm and extending substantially perpendicularly outward from said second tube, said second arm including a second hinge attached to the distal end of said second arm, a first clutch bearing having an inner race and an outer race, and wherein the inner race of said first clutch bearing is attached to said first hinge, a second clutch bearing having an inner race and an outer race, and wherein said inner race of said second clutch bearing is attached to said second hinge, first brake means positioned in contact with said outer race of said first clutch bearing, said first brake means creating a frictional resistive force with said outer race of said first clutch bearing, second brake means positioned in contact with said outer race of said second clutch bearing, said second brake means creating a frictional resistive force with said outer race of said second clutch bearing, a first oar arm attached to said first brake means, a second oar arm attached to said second brake means, a seat bracket including a horizontal planar member, a first pair of rollers and a second pair of rollers rotatably mounted to the underside of said planar member, wherein said first pair of rollers are spaced apart said first predetermined distance from said second pair of rollers, and said first and said second pair of rollers having a surface profile adapted to engage said first and said second tubes, and wherein said seat bracket is situated so that said first pair of rollers engages and rests upon said first tube and said second pair of rollers engages and rests upon said second tube, a seat cushion attached to said horizontal planar member, and a horizontal foot rest attached to said second support bracket.

One object of the present invention is to provide an improved portable rowing machine.

Another object of the present invention is to provide a portable rowing machine that is configurable in an operating configuration and configurable into a storage configuration having a small footprint.

Yet another object of the present invention is to provide a portable rowing machine that includes an oar arm mechanism that operates to accurately recreate actual rowing resistance.

These and other objects of the present invention will become more apparent from the following figures and description of the preferred embodiment.

DESCRIPTION OF THE PREFERRED EMBODIMENT

Figure 1:
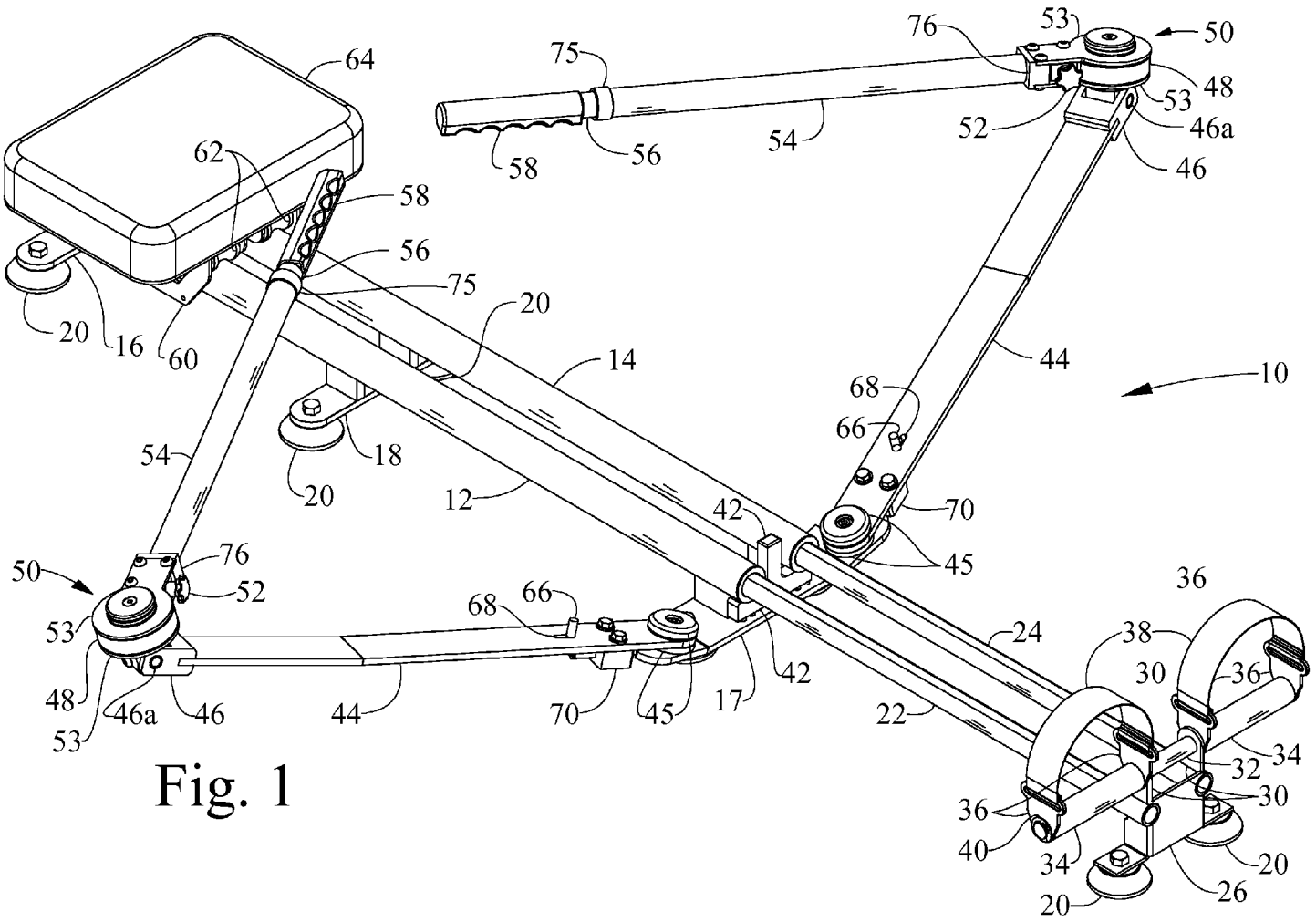
FIG. 1 is a top perspective view of a portable rowing machine according to the present invention shown in a fully extended operational configuration.

For the purposes of promoting an understanding of the principles of the invention, reference will now be made to the embodiment illustrated in the drawings and specific language will be used to describe the same. It will nevertheless be understood that no limitation of the scope of the invention is thereby intended, such alterations and further modifications in the illustrated device, and such further applications of the principles of the invention as illustrated therein being contemplated as would normally occur to one skilled in the art to which the invention relates.

Figure 2:
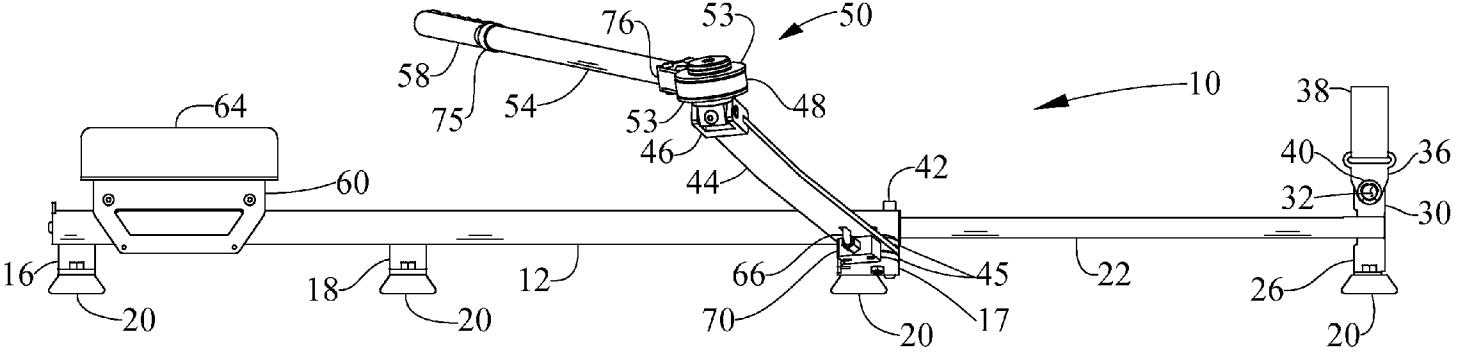
FIG. 2 is a side elevational view of the portable rowing machine of FIG. 1.
Figure 3:
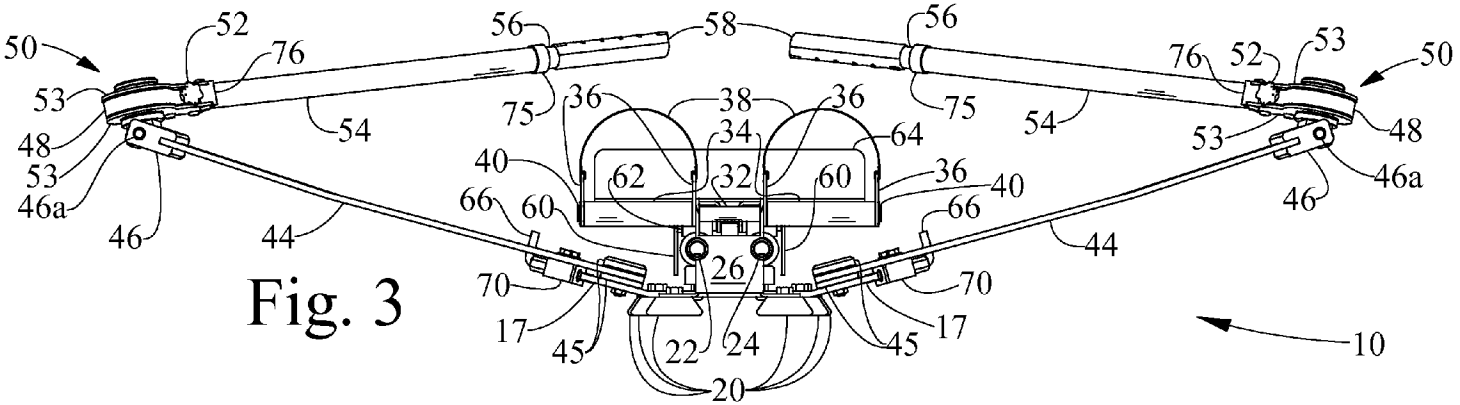
FIG. 3 is an end view of the portable rowing machine of FIG. 1.

Referring now to FIGS. 1, 2 and 3, a portable rowing machine 10 according to the present invention is shown. FIG. 1 is a perspective view of rowing machine 10. FIG. 2 is a side view of rowing machine 10. FIG. 3 is an end view looking from the foot end of rowing machine 10. FIGS. 1-3 depict rowing machine 10 in operational configuration. Rowing machine 10 includes a frame consisting of tubes 12 and 14 which are situated in a parallel arrangement as shown with foot plate brackets 16 and 18 providing vertical support from below to tubes 12 and 14 as well as establishing parallel spacing of tubes 12 and 14. Foot plate brackets 16 and 18 are attached (preferably welded) to tubes 12 and 14 and provide vertical support from below as well as establishing fixed parallel spacing between tubes 12 and 14. In addition, brackets 16 and 18 include apertures for mounting rubber feet 20 to the underside of brackets 16 and 18. Rail plate bracket 17 is also attached to the underside of tubes 12 and 14 at the location shown. Tubes 22 and 24 are radially sized for insertion into tubes 12 and 14 and are slidably received therein to create a telescoping assembly. Slide rail bracket 26 is attached at the distal ends of tubes 22 and 24 as shown to maintain tubes 22 and 24 in parallel spaced apart alignment. Bracket 26 includes apertures therein for mounting rubber feet 20 to the underside thereof. Bracket 26 also includes ears 30 projecting above tubes 22 and 24 wherein foot rod 32 is attached. Foot rod spacers 34 are hollow tubes positioned over rod 32 and include foot strap brackets 36 situated at both ends of foot rod spacers 34. Two flexible foot straps 38 are attached as shown to the four foot strap brackets 36 and are adjustable in length to receive a variety of foot sizes between strap 38 and foot rod spacer 34. Brackets 36 and spacers 34 are retained on tube 32 by way of c-clips 40 engaging slots at the distal ends of tube 32.

Figure 16:
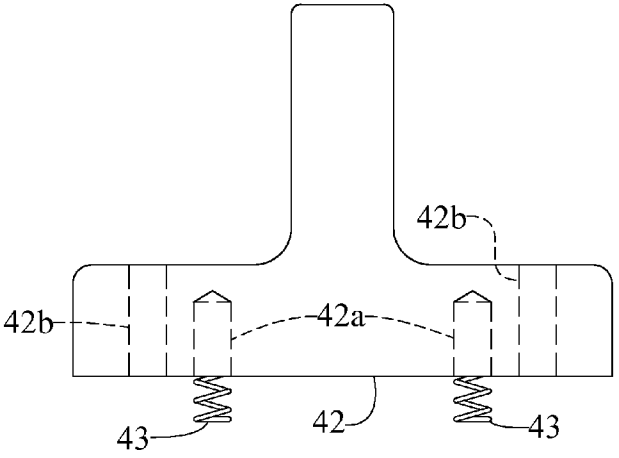
FIG. 16 is a front elevational view of release block 42.
Figure 17:
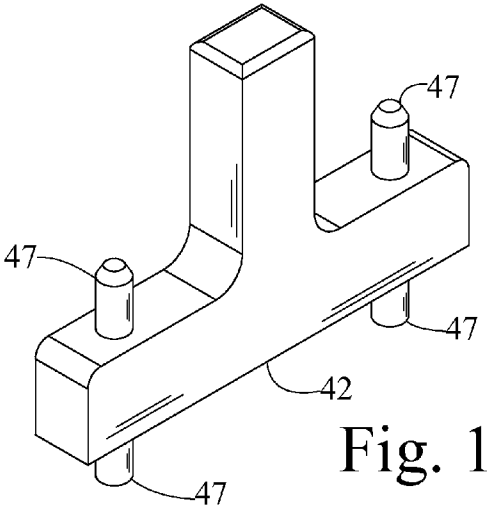
FIG. 17 is a front perspective view of release block 42.

Release block 42 is vertically movable between bracket 17 and tubes 22 and 24. Release block 42 is situated on vertically oriented pins attached to bracket 17 and a spring (shown in FIG. 16) urges block 42 upwards in contact with tubes 22 and 24. Release block 42 also includes locating pins (shown in FIG. 17) extending upward therefrom that engage a series of holes or apertures (shown in FIG. 13) machined in the underside of tubes 22 and 24 to provide a plurality of locking positions for tubes 22 and 24 as they are extended or telescoped outward from within tubes 12 and 14. The flat surfaces on the uppermost surfaces of tubes 22 and 24 provide an area upon which numerals are placed (either using permanent markings, adhesive labels or by way of machining) that enable the user of machine 10 to quickly extend tubes 22 and 24 outward from a storage position where bracket 24 is adjacent bracket 17 to a desired operating position based on the height and leg length of the user of machine 10. More detail regarding release block 42 is shown in FIGS. 16 and 17.

Swivel arms 44 are pivotally attached to rail plate bracket 17 and extend substantially perpendicularly outward from and slightly above tubes 12 and 14 in the operational position shown in FIGS. 1-3. Washers or bushing spacers 45 are positioned on both sides of swivel arm 44 adjacent the attachment point to bracket 17 to reduce friction between swivel arms 44 and bracket 17 and provide support for swivel arms 44. Hinges 46 are mounted to the distal end of arms 44. Band brakes 48 and clutch bearing assemblies 50 are mounted on hinges 46 and are pivotal about pivot pin 46*a*. Clutch bearing assemblies 50 include band brakes 48 which make frictional contact with the outer bearing race of clutch bearings situated within assemblies 50. Brake adjustment knobs 52 provide a mechanism for mechanical adjustment of the frictional or resistive force created between clutch bearing assemblies 50 and band brakes 48. Band brake covers 53 are mounted over clutch bearing assemblies 50 to enclose band brake 48 and clutch bearing assembly 50 components. Oars 54 are attached to band brakes 48 via band brake holders 76. The free ends of oars 54 extend inwards and over toward tubes 22 and 24. Oars 54 include oar extensions 56 that are telescoping tubes situated within oars 54 and axially movable and lockable within oars 54. Compression nuts 75 and split rings (shown in FIG. 20) within nuts 75 provide a locking mechanism to secure oar extensions 56 in any axial telescoping position with respect to oars 54. Compression nuts 75 and corresponding split rings are products manufactured by Valco/Valley Tool and Die, Inc. of North Royalton, Ohio (www.valcocleve.com), part numbers NC-100 and NC-1087, that function to lock the axial position of oar extension 56 with respect to oar tube 54. Handle grips 58 are attached over the distal ends of oar extensions 56 and provide a convenient gripping surface for the user of machine 10.

Roller bracket 60 includes four rollers 62 having concave surfaces that are rotatably attached as shown and which are situated to engage and rest upon the upper surfaces of tubes 12 and 14. Bracket 60 also includes a horizontal surface upon which seat cushion 64 is mounted. Rollers 62 enable bracket 60 and cushion 64 to move freely along the upper surface of tubes 12 and 14 when an operator is seated thereon and operating rowing machine 10.

Locking pins 66 are linearly movable in slots 68 formed in swivel arms 44. Locking pin retainers 70 are attached to the underside of arms 44 and include springs (not shown) that urge locking pins 66 toward rail plate bracket 17. Rail plate bracket 17 includes slots 17*a* and 17*b* (see FIG. 15) for receiving locking pins 66. Swivel arms 44 are positioned in one of two positions, a storage position (shown in FIGS. 4-6) and an extended or operating position (shown in FIGS. 1-3). Moving locking pins 66 toward corresponding hinges 46 releases swivel arms 44 for rotational movement into either the operating position or the storage position. Upon moving swivel arms 44 into one of the two available rotational positions, locking pins 66 reengage slots 17*a* or 17*b* (see FIGS. 4 and 15) in bracket 17 to lock swivel arms 44 in position.

Operationally speaking, a user depresses release block 42, slides tubes 22 and 24 in a telescoping fashion outward from within tubes 12 and 14 to a desired leg length position, sits upon cushion 64, places his feet inside straps 38, grips handles 58 and slides seat bracket 60 along tubes 12 and 14 while pulling the handles 58. Clutch bearing assemblies 50 enable a free movement of the oars 54 toward bracket 26 and present a resistance to movement in the opposite direction of movement. The resistance to movement of the oars when moved away from bracket 26 toward bracket 16 is created by the band brake and clutch bearing interaction which will be further discussed in detail below. When the user is finished with exercising on rowing machine 10, locking pins 66 are moved outward to enable swivel arms 44 to pivotally rotate into a position adjacent tubes 12 and 14 and release block 42 is depressed to enable tubes 22 and 24 to slide within tubes 12 and 14 thereby reducing the width, height and length of rowing machine 10 for storage purposes.

Figure 4:
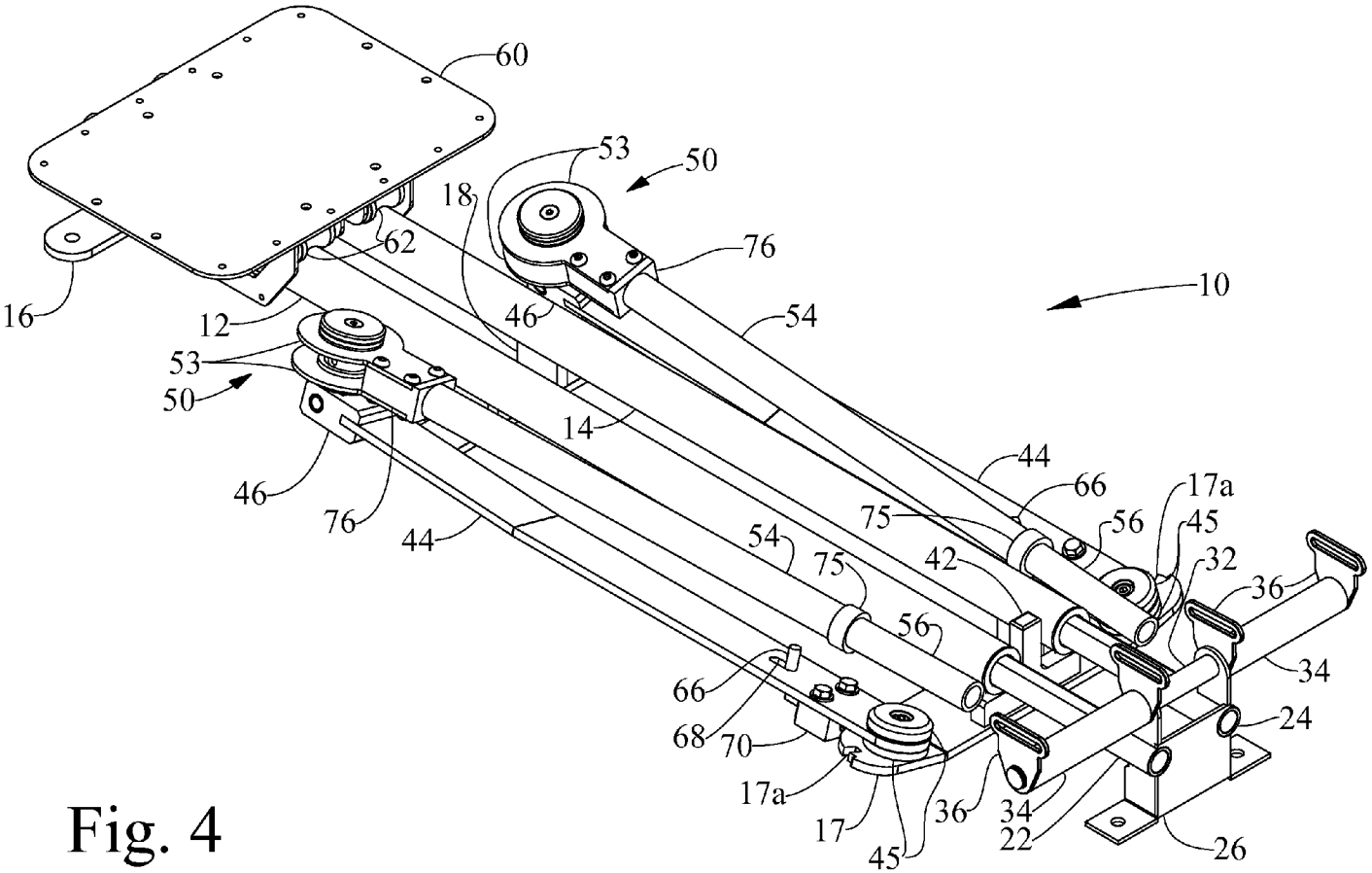
FIG. 4 is a top perspective view of the portable rowing machine of FIG. 1 in a storage configuration and having some parts not shown.
Figure 5:
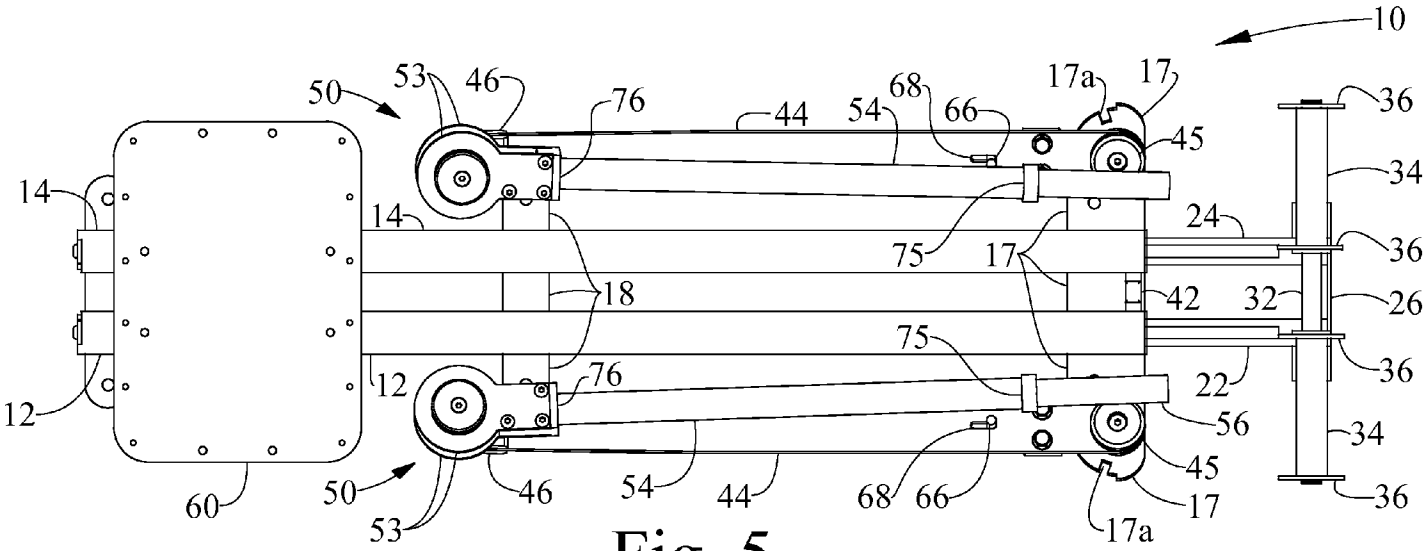
FIG. 5 is a plan view of the rowing machine shown in FIG. 4.
Figure 6:
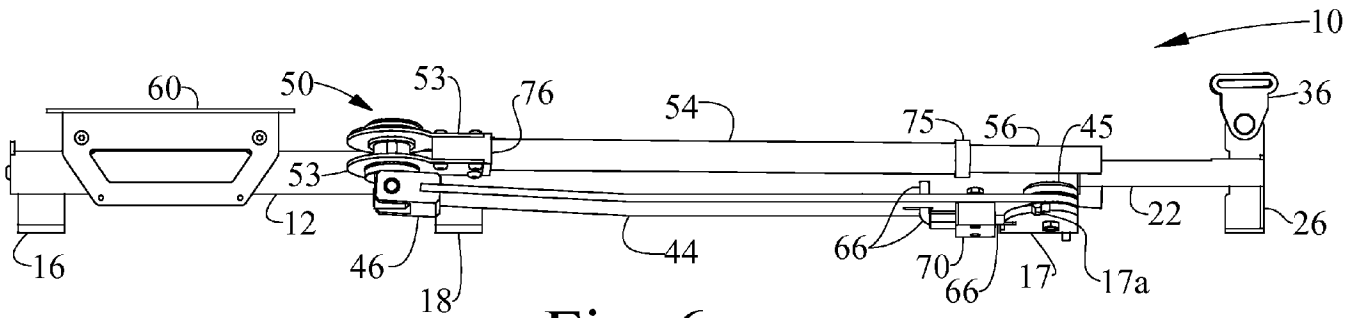
FIG. 6 is a side elevational view of the rowing machine shown in FIG. 4.

Referring now to FIGS. 4-6, portable rowing machine 10 is shown configured into the storage position. FIG. 4 is a perspective view, FIG. 5 is a plan view, and FIG. 6 is a side elevational view of rowing machine 10 with several items such as seat cushion 64, rubber feet 20, foot straps 38, band brakes 48 and handle grips 58 removed from each figure. Tubes 22 and 24, attached to slide rail bracket 26, are shown in the retracted or storage telescoping position. The storage position shown for the foot support area of machine 10 is realized (from the extended position) by depressing release block 42 downwards and applying horizontal force to bracket 26 in the direction of bracket 17 thereby sliding tubes 22 and 24 into tubes 12 and 14, respectively. Swivel arms 44 are shown in the storage position with oars 54 positioned adjacent arms 44 to achieve the most compact height footprint for rowing machine 10. Locking pins 66, movable in slots 68, are shown positioned in slot 17*b* of bracket 17 (see FIG. 15) so that swivel arms 44 are secured in the storage position shown. Slots 17*a* are engaged by pins 66 when arms 44 are extended outward. Band brake covers 53 are attached to band brake holders 76 (shown in more detail in FIG. 18).

Also shown in FIGS. 4-6 are roller bracket 60, rollers 62, brackets 16 and 18, oar extensions 56, hinges 46, clutch bearing assemblies 50, foot rod 32, foot rod spacers 34, and foot strap brackets 36, compression nuts 75, washers or bushings 45 and locking pin retainers 70.

Figure 7:
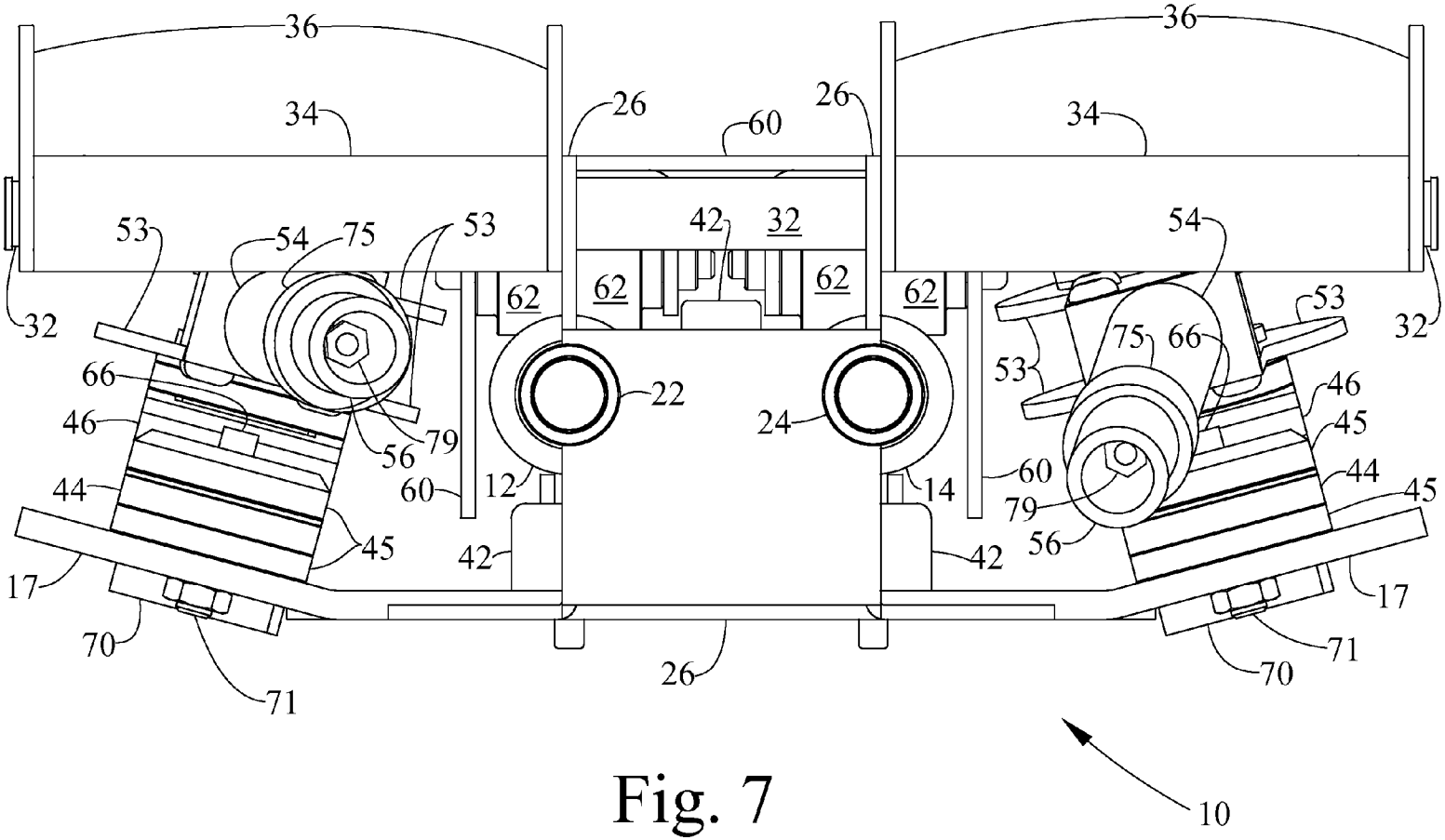
FIG. 7 is an end view of the rowing machine shown in FIG. 4.

Referring now to FIG. 7, an enlarged end view of rowing machine 10 is shown from the slide rail bracket 26 end thereof. Some items such as handle grips 58, band brakes 48, clutch bearings 51, foot straps 38 and rubber feet 20 are not shown in this figure. Tubes 22 and 24 are shown axially positioned within tubes 12 and 14, respectively. Tubes 22 and 24 are attached to slide rail bracket 26 as shown. Bushing washers 45 are positioned on upper and lower surfaces of swivel arms 44 where arms 44 are pivotally attached to bracket 17. Nut and bolt fasteners 71 pivotally secure swivel arms 44 and washers 45 in place on bracket 17. Swivel arms 44 are shown positioned in a storage position. Hinges 46 are attached to swivel arms 44. Rollers 62 are shown attached to roller bracket 60 and positioned to rotatably engage the upper surfaces of tubes 12 and 14. Oars 54 and oar extensions 56 are shown positioned adjacent swivel arms 44 in a storage position depicting the typical minimized height and minimized width required for storage of rowing machine 10. Lock nuts 79 are shown situated on the end of rods 74 (both shown in FIG. 10). Locking pins 66, brake covers 53, release block 42, foot rod 32, foot rod spacers 34, compression nuts 75, locking pin retainers 70 and foot strap brackets 36 are also shown.

Figure 8:
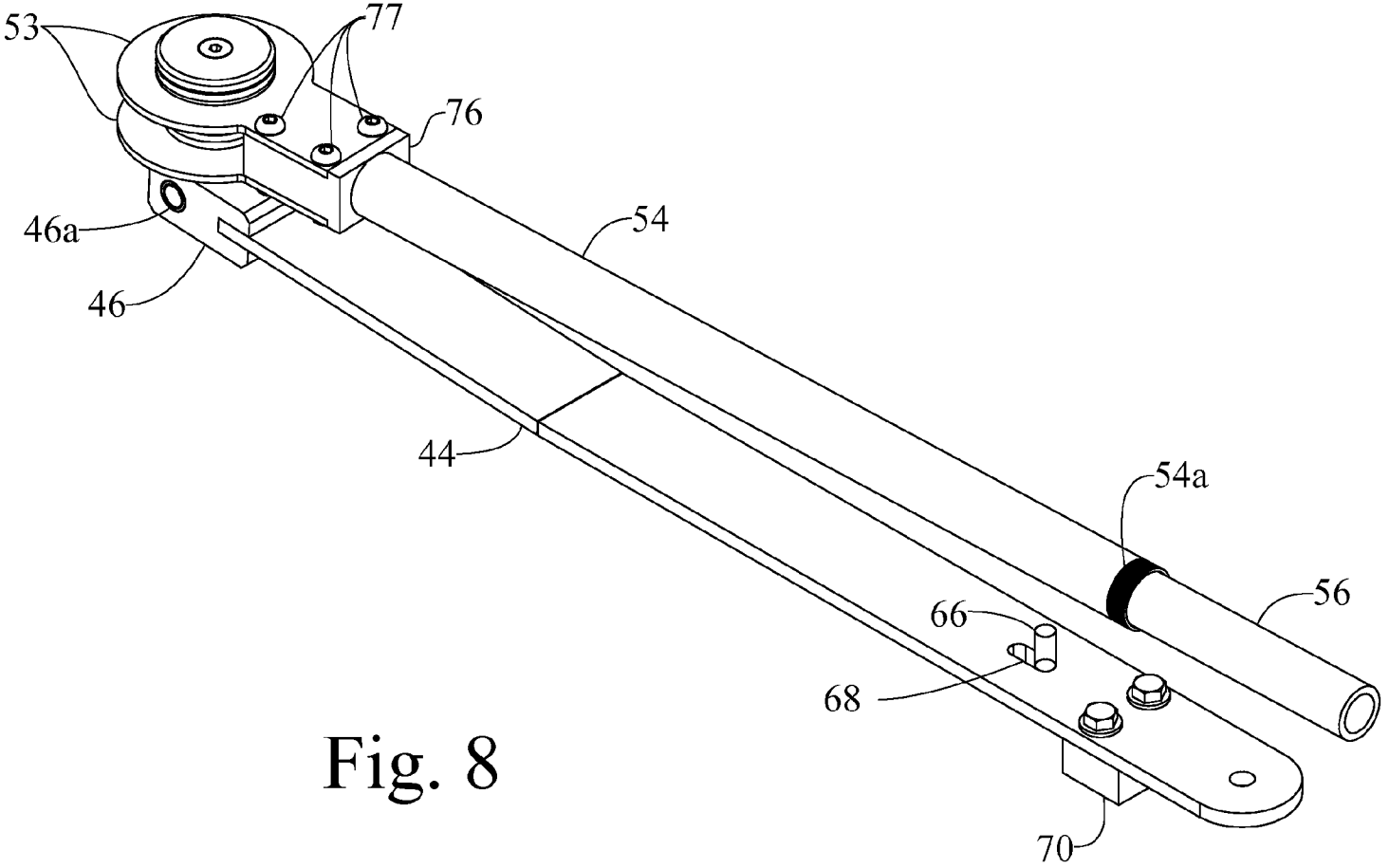
FIG. 8 is a top perspective view of a swivel arm-oar assembly shown in FIG. 4.
Figure 9:
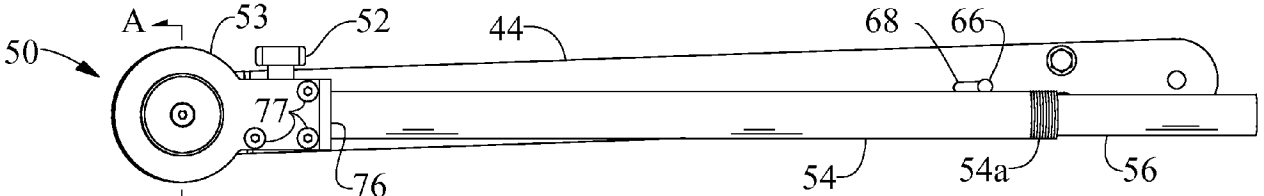
FIG. 9 is a plan view of a swivel arm-oar assembly.
Figure 10:
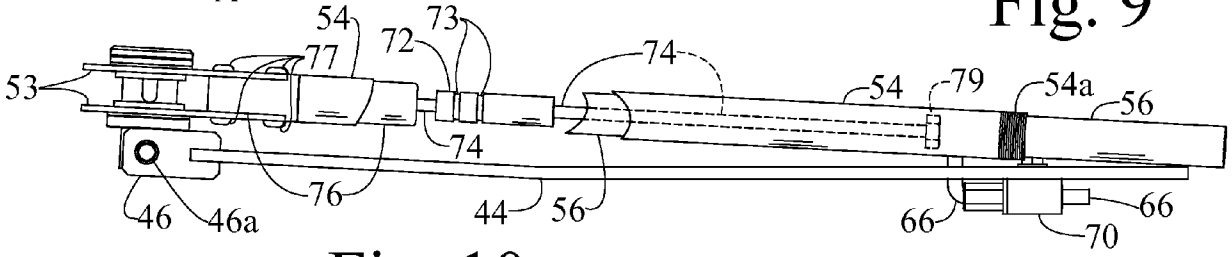
FIG. 10 is a partial cutaway side elevational view of a swivel arm-oar assembly.

Referring now to FIGS. 8-10, additional details for the swivel arm-oar assemblies of FIG. 1-6 are shown. FIG. 8 is a perspective view, FIG. 9 is a plan view, and FIG. 10 is a partial cutaway side view of a swivel arm-oar assembly. Some items are not shown in FIGS. 8 and 10, in particular, band brake 48, clutch bearing 51, compression nut 75 and handle grips 58. The components of both swivel arm-oar assemblies of rowing machine 10 are identical in components and construction with the only difference being the operating direction (clockwise versus counter-clockwise) of the clutch bearing installed in each assembly 50. Inverted installation of the clutch-bearing 51 (FIG. 12) provides this rotational difference in the assembly of the swivel arm-oar assemblies. Locking pin retainer 70 is attached to the underside of swivel arm 44 to retain locking pins 66 in slot 68 of swivel arm 44. A spring (not shown) situated within locking pin retainer 70 urges locking pin 66 into the position shown. Hinge 46 is attached to swivel arm 44 to enable pivotal movement of arm 44 with respect to oar 54 about hinge pin 46*a*. Oar extension 56 is situated within oar 54 and is movable axially within oar 54 to provide an adjustable length rowing oar. Oar extension 56 receives oar stop 72 (FIG. 10) axially within oar extension 56. Oar extension 56 is inwardly radially crimped onto grooves 73 in oar stop 72 to secure oar stop 72 within oar extension 56. Oar stop 72 is constructed of nylon, Delrin or other similar material. Adjustment of overall oar length is achieved by rotating compression nut 75 (see FIGS. 1-3) and adjusting the axial position of oar extension 56 with respect to oar 54, then rotating compression nut 75 in a clockwise direction to lock the compression nut and split ring (FIG. 20) between oar 54 and oar extension 56. Rod 74 is threaded at both ends and mounted in a threaded aperture in band brake holder bracket 76 at one end. Lock nut 79 is attached to the opposing threaded end of rod 74. Oar extension 56 is retained on rod 74 and within oar 54 by oar stop 72 which moves freely on rod 74 and contacts lock nut 79 when oar extension 56 is moved axially away from hinge 46. Brake covers 53 are attached using screws 77 to band brake holder 76. Band brake adjustment knob 52 is also shown in FIG. 9. Compression nuts 75 (shown in FIGS. 1-3) are threaded onto threaded portions 54*a* (shown in FIGS. 8-10) of oar 54.

Figure 11:
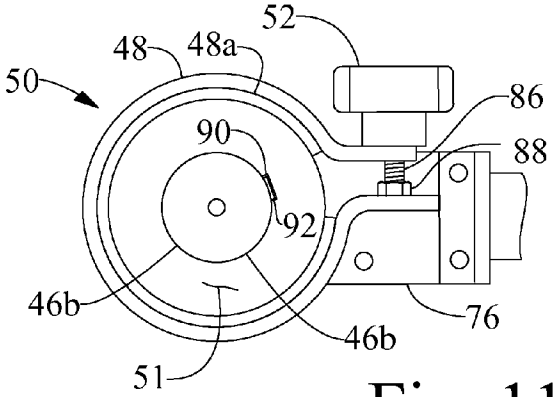
FIG. 11 is a plan view of the brake-clutch bearing assembly 50.

Referring now to FIG. 11, a plan view of bearing assembly 50, with the upper brake cover 53 removed, is shown. Bearing assembly 50 includes band brake 48, hinge portion 46*b*, brake covers 53 (shown in FIG. 9) and clutch bearing 51. Band brake 48 includes a braking material 48*a* attached about the inner periphery thereof. Band brake 48 is attached to band brake holder 76 via threaded rod 86 and nut 88. Brake adjustment knob 52 is screwed onto threaded rod 86 to enable adjustment of the braking force applied by band brake 48 to the outer periphery or outer race of clutch bearing 51. Clutch bearing 51 is positioned over a cylindrical part of hinge portion 46*b* and shaft key 90 is positioned in a keyway in the inner race surface of bearing 51 that is aligned with a keyway 92 in cylindrical portion of hinge portion 46*b* at location 92.

Figure 12:
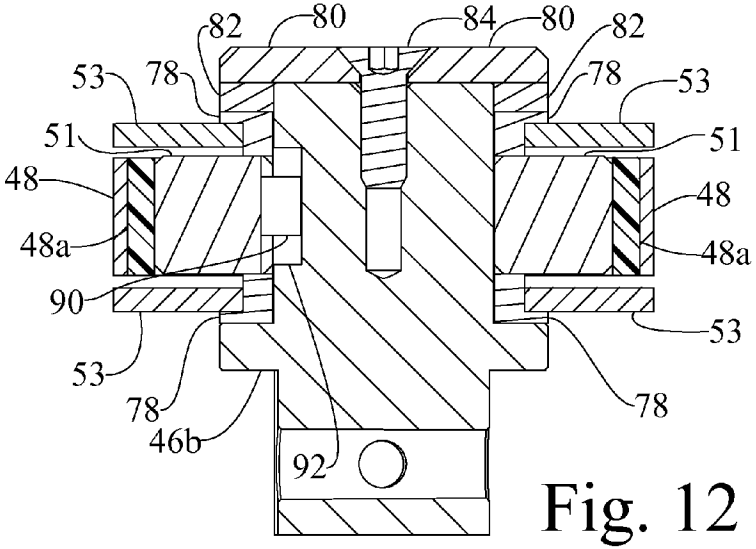
FIG. 12 is a cross-sectional view of the brake-clutch bearing assembly 50 looking in the direction of the arrows labeled A-A in FIG. 9.

Referring now to FIG. 12, a cross-sectional view of clutch bearing assembly 50 looking in the direction of the arrows labeled A-A of FIG. 9 is shown. Clutch bearing 51 is situated on cylindrical portion of hinge 46*b* (see FIG. 19). Band brake 48 and braking material 48*a* are situated about the external cylindrical surface or outer race of clutch bearing 51. Band brake covers 53 are situated above and below brake 48 and positioned by bushings or spacers 78 as shown. Spacer 82 is situated between upper band brake cover 53 and band brake cap 80 to prevent vertical movement of bushings 78 and bearing 51. Screw 84 secures spacer 82 and bushings 78 in position without applying any force to the inner race of bearing 51. Shaft key 90 is positioned in a keyway in the inner race of bearing 51 and a keyway in cylindrical portion 46*b* at location 92 to prevent rotational movement of the inner race of clutch bearing 51. Brake covers 53 move freely about cylindrical portion 46*b* yet are retained in position by bushings or spacers 78. Clutch bearing 51 is a model number CSK30-P manufactured by Xinchang Peak Bearings Co., LTD of Qingshan Industrial Park, Xinchang, Zhejiang 312500, China. Clutch bearings that permit rotation in one direction and lock in the opposing rotational direction are common and other sources for such products are well known in the art. Operationally speaking, when an oar arm is rotated by the user, brake covers 53 and band brake 48 are also rotated about the central axis of the cylindrical part of hinge portion 46*b*. Clutch bearing 51 allows free movement in one direction, yet locks up in the opposite direction, thus non-frictional motion is enabled for the brake 48 and clutch bearing 51 rotation in a first rotational direction, and the opposing direction rotation causes clutch bearing 51 to lock the inner race to the outer race and the user must overcome the friction between band brake 48 and the outer race of bearing 51 to move the oar arm in that direction thereby creating a rowing comparable motion resistance.

Figure 13:
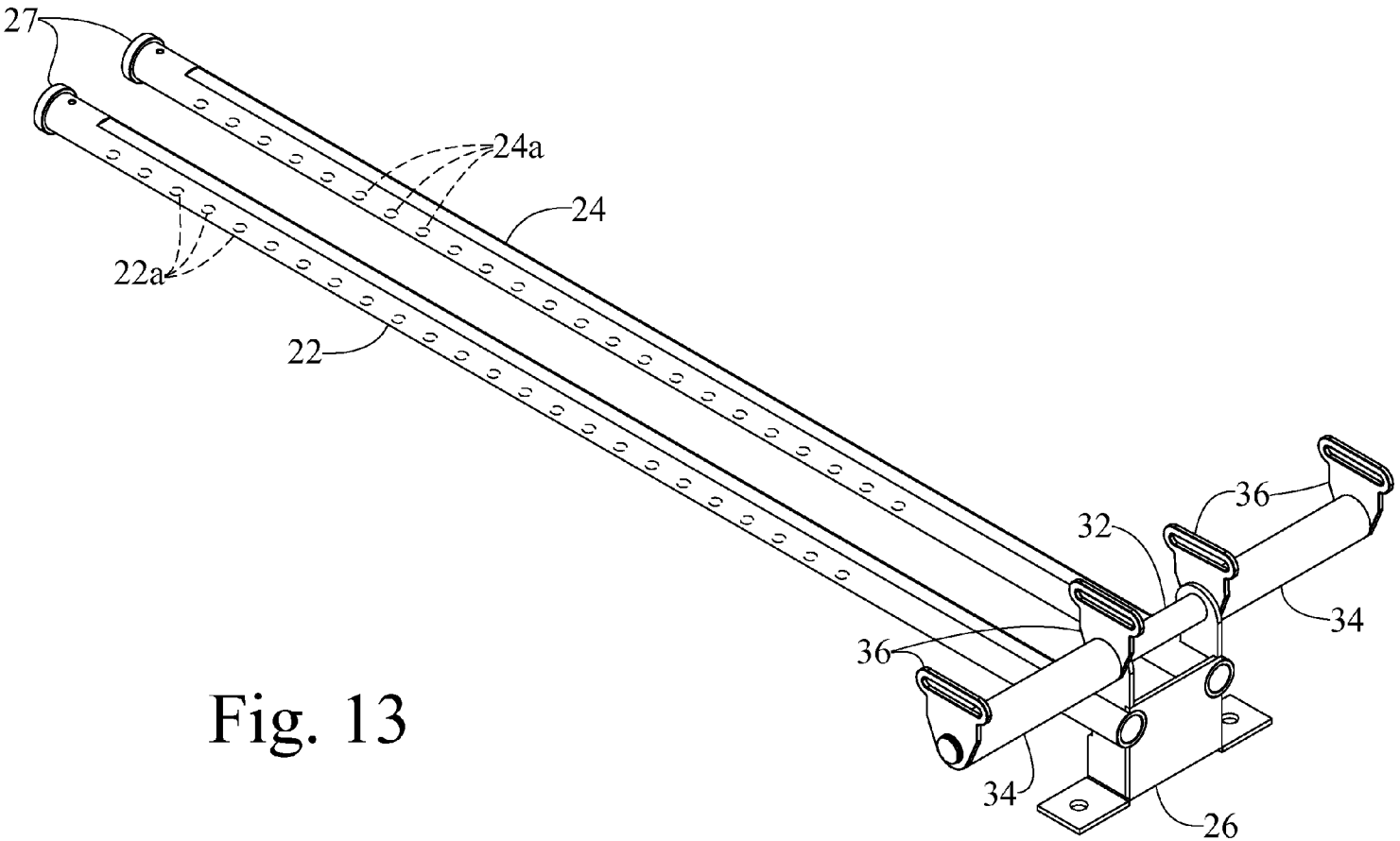
FIG. 13 is a top perspective view of the slide rail assembly with some items removed.

Referring now to FIG. 13, a perspective view of the assembly of slide rail bracket 26 and tubes 22 and 24 is shown. Slide rail plugs 27 are secured within the ends of tubes 22 and 24 to provide a friction reducing and mechanical centering function in relation to tubes 12 and 14 of FIGS. 1-3. Slide rail plugs 27 also serve to prevent inadvertent disassembly of tubes 22 and 24 from within tubes 12 and 14. An array of apertures 22*a* and 24*a* are machined in the lower surfaces of tubes 22 and 24, respectively. Apertures 22*a* and 24*a* are engaged by locating pins situated in release block 42 (see FIG. 17). Foot rod 32, foot rod spacers 34, and foot strap brackets 36 are also shown.

Figure 14:
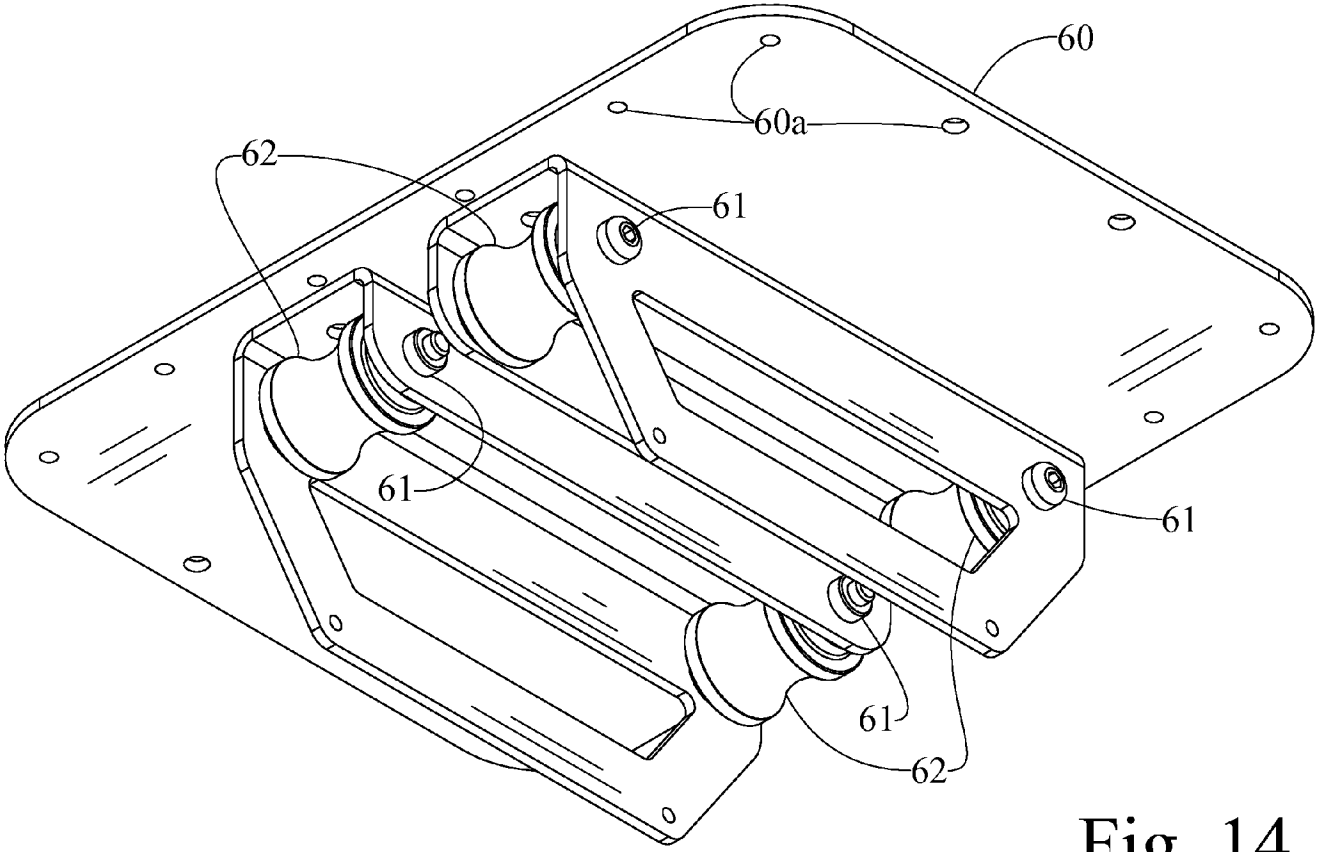
FIG. 14 is a bottom perspective view of the seat bracket depicting the rollers mounted to the underside thereof.

Referring now to FIG. 14, a perspective view of the underside of roller bracket 60 is shown. Rollers 62 are rotatably attached via fasteners 61 to the underside of bracket 60 as shown and spaced apart to correspond with the separation distance between tubes 12 and 14 (see FIG. 1). Apertures 60*a* provide a series of through holes for attaching seat cushion 64 (FIG. 1) to bracket 60.

Figure 15:
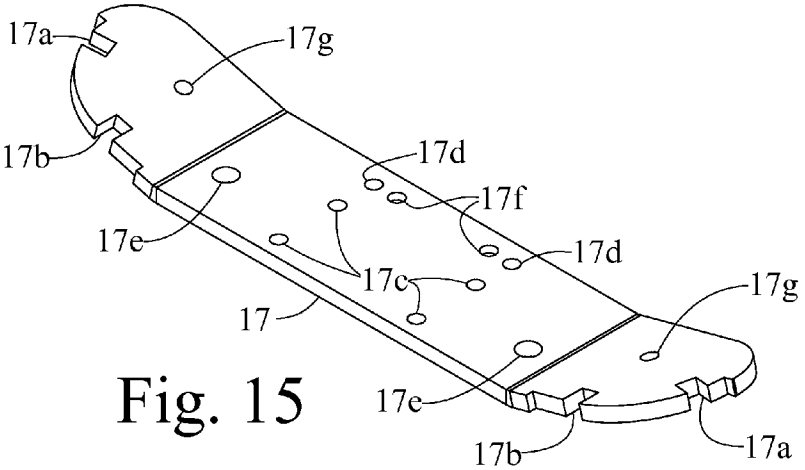
FIG. 15 is a top perspective view of rail plate bracket 17.

Referring now to FIG. 15, a perspective view of rail plate bracket 17 with riser blocks removed is shown. Rail plate bracket 17 includes slots 17*a* and 17*b* that receive locking pins 66 (FIGS. 1-3) for positioning of swivel arms 44 into one of two positions, namely a storage position and an open or operational position for rowing machine 10. Apertures 17*c* provide a mounting location for the attachment of riser blocks (shown in FIG. 1) that form a part of rail plate bracket 17 and are disposed between tubes 12 and 14 and rail plate bracket 17. Apertures 17*d* receive pins 47 (see FIG. 17) mounted in release block 42 to retain release block 42 in position over bracket 17 and adjacent tubes 12 and 14. Apertures 17*e* receive rubber feet 20. Recesses 17*f* receive return springs 43 (shown in FIG. 16) that engage apertures 42*a* (see FIG. 16) in release block 42 urging release block 42 upward. Swivel arms 44 (FIG. 1) are attached in apertures 17*g*.

Referring now to FIGS. 16 and 17, a front view and a top perspective view of release block 42 of FIGS. 1-6 are shown, respectively. Apertures 42*a* receive springs 43 that engage apertures 17*f* in rail plate bracket 17 (FIG. 15). Apertures 42*b* in block 42 receive pins 47 which extend upward through holes (not shown) in tubes 12 and 14 to engage adjacent pairs of positioning holes 22*a* and 24*a* situated along the underside of tubes 22 and 24 (see FIG. 13) thereby locking the extension position of tubes 22 and 24 with respect to tubes 12 and 14 of FIG. 1. Pins 47 are situated in apertures 17*d* of bracket 17.

Figure 18:
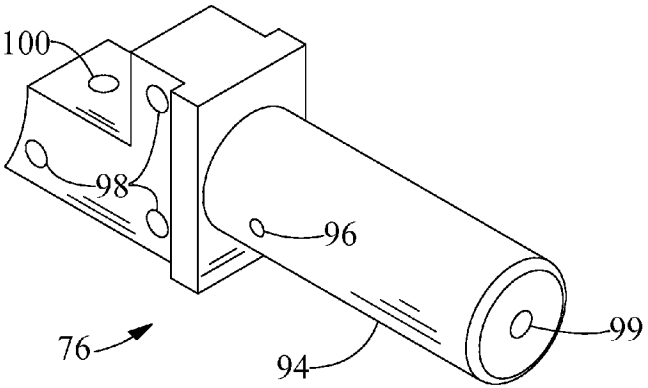
FIG. 18 is a front perspective view of band brake holder 76.

Referring now to FIG. 18, a perspective view of band brake holder 76 is shown. Holder 76 provides a mechanical attachment mechanism for affixing oar arms 54 to the band brakes 48 and band brake covers 53. Oars 54 are attached over cylindrical portion 94 and secured via a locking pin inserted into aperture 96. Apertures 98 receive bolts or screws that secure band brake covers 53 to band brake holder 76. Threaded aperture 100 receives threaded rod 86 which forms a portion of the band brake adjustment mechanism. Threaded aperture 99 receives rod 74 shown in FIG. 10.

Figure 19:
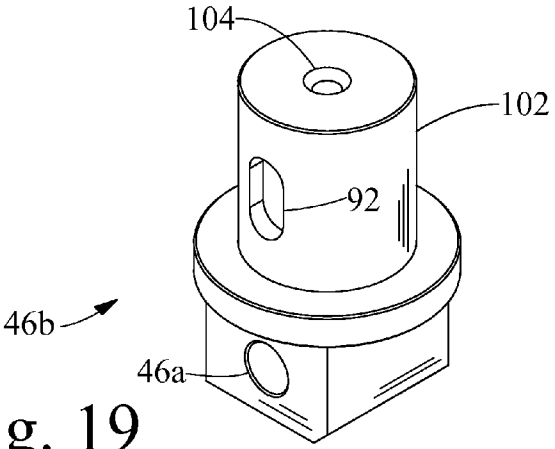
FIG. 19 is a front perspective view of cylindrical hinge portion 46*b*.

Referring now to FIG. 19, a perspective view of hinge portion 46*b* that forms a part of hinge 46 is shown. Clutch bearing 51 is installed over cylindrical portion 102. Keyway 92 receives shaft key 90 (FIG. 12) to prevent rotation of the inner race of clutch bearing 51. A hinge pin is installed at location 46*a* about which the two parts of hinge 46 are pivotally assembled. Threaded aperture 104 receives screw 84 (FIG. 12).

Figure 20:
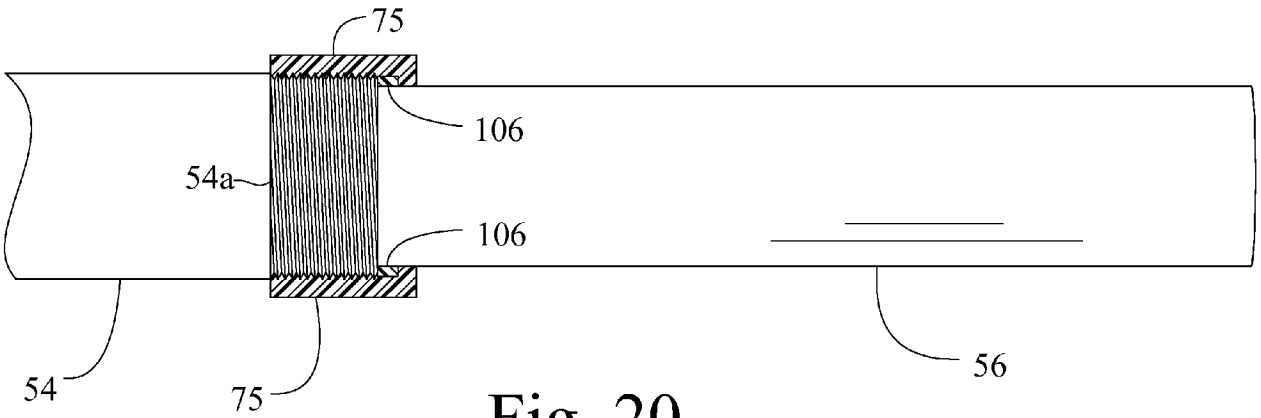
FIG. 20 is a close up elevational view of an oar 54 and oar extension 56 of FIG. 1 including a cross-section of compression nut 75.

Referring now to FIG. 20, a partial front elevational view of oar 54 and oar extension 56 is shown. In this figure, particular detail is provided for compression nut 75 and split ring 106 shown in cross-section. Oar extension 56 is disposed within oar 54 and axially movable therein when compression nut 75 is loosened. The interior of compression nut 75 includes an axial taper in the area adjacent split ring 106. Nut 75 applies inward axial pressure to split ring 106 when nut 75 is tightened onto threads at 54*a* in oar 54. The force applied to split ring 106 serves to lock the position of oar extension 56 with respect to oar 54 thereby enabling locking telescoping adjustment of the overall oar length for rowing machine 10. Such telescopic tubular extension locking mechanisms are known in painting and cleaning extension handle products of the prior art.

Most of the components of rowing machine 10 that are structural in nature are fabricated from high strength metals such as aluminum or steel. For the unlimited budget customer, exotic metals such as titanium may be used. The use of aluminum for brackets and tubes serves to reduce the overall weight of machine 10. Oar arms 54 and oar arm extensions 56 tubing is preferably made from steel tubing as these components are subjected to significant stresses when the user operates machine 10. Bushings and friction reducing washers are fabricated from delrin, nylon or other similar materials having low friction contact properties and light weight yet also having high strength characteristics.

While the invention has been illustrated and described in detail in the drawings and foregoing description of the preferred embodiment, the same is to be considered as illustrative and not restrictive in character, it being understood that only the preferred embodiment has been shown and described and that all changes and modifications that come within the spirit of the invention are desired to be protected.

What is claimed is:

1. A rowing machine comprising:

a frame consisting of a first tubular member and a second tubular member wherein said first and second tubular member are disposed in parallel relationship and a first cross member attached to said first and said second tubular members and a second cross member attached to said first and second tubular members;

a foot rest assembly including a third tubular member, a fourth tubular member and a third cross member attached near a distal end of said third and fourth tubular members, said third and fourth tubular members separated by a distance corresponding to the displacement between said first and second tubular members and wherein said third and fourth tubular members are slidably inserted within said first and second tubular members, respectively;

a first swivel arm pivotally attached to said first cross member at a location near said first tubular member, said first swivel arm being pivotally positionable between a first angular position substantially parallel to said first tubular member and a second angular position substantially away from said first tubular member;

a first resistance means having a first shaft and a second shaft, and wherein said first shaft is attached to the distal end of said first swivel arm, said first resistance means providing rotational resistance between said first shaft and said second shaft in only one rotational direction;

a first oar arm attached to said second shaft of said first resistance means;

a second swivel arm pivotally attached to said first cross member at a location near said second tubular member, said second swivel arm being pivotally positionable between a first angular position substantially parallel to said second tubular member and a second angular position substantially away from said second tubular member;

a second resistance means having a third shaft and a fourth shaft, and wherein said third shaft is attached to the distal end of said second swivel arm, said second resistance means providing rotational resistance in only one rotational direction between said third shaft and said fourth shaft;

a second oar arm attached to said fourth shaft of said first resistance means; and a seat including spaced apart rollers rotatably attached to the underside of said seat, and wherein said seat is situated over said first and second tubular members and said rollers engage said tubular members.

2. The rowing machine of claim 1 including:

a first length extending means attached to said first oar arm for extending the length of said first oar arm up to a first predetermined length longer than said first oar arm; and a second length extending means for attached to said second oar arm for extending the length of said second oar arm up to a first predetermined length longer than said second oar arm.

3. The rowing machine of claim 2 including foot rest locking means situated partially on said foot rest assembly and partially on said frame for locking said foot rest assembly in position with respect to said frame when said third and fourth tubes are positioned within said first and second tubes, respectively.

4. The rowing machine of claim 3 wherein said first resistance means is pivotally attached to the distal end of said first swivel arm and said second resistance means is pivotally attached to the distal end of said second swivel arm.

5. The rowing machine of claim 4 wherein:

said first resistance means includes a first clutch bearing having an inner race and an outer race, and wherein said inner race of said first clutch bearing comprises said first shaft, said first resistance means further including a first band brake that engages said outer race of said first clutch bearing to apply a frictional force thereto, and wherein said outer race of said first clutch bearing and said first band brake comprise said second shaft, and wherein said first oar arm is attached to said first band brake; and wherein said second resistance means includes a second clutch bearing having an inner race and an outer race, and wherein said inner race of said second clutch comprises said third shaft, said second resistance means further including a second band brake that engages said outer race of said second clutch bearing to apply a frictional force thereto, and wherein said second outer race of said second clutch bearing and said second band brake comprise said fourth shaft, and wherein said second oar arm is attached to said second band brake.

6. The rowing machine of claim 5 including:

first band brake adjustment means attached to said first band brake for varying the frictional force applied by said first band brake to said outer race of said first clutch bearing; and second band brake adjustment means attached to said first band brake for varying the frictional force applied by said second band brake to said outer race of said second clutch bearing.

7. The rowing machine of claim 6 wherein said inner race of said first clutch bearing is hingedly attached to said first swivel arm and said inner race of said second clutch bearing is hingedly attached to said second swivel arm.

8. A portable rowing machine comprising:

a frame including a first tube having a first end and a second end, a second tube having a first end and a second end, a first support bracket attached to said first tube and said second tube near said first end of said first and second tubes, and a second support bracket attached to said first tube and said second tube at a location between said first end and said second end of said first tube and said second tube and spaced apart from said first support bracket, said first support bracket and said second support bracket maintaining said first tube and said second tube in a horizontal parallel relationship at a first predetermined distance;

a frame extension including a third tube having a first and a second end, a fourth tube having a first end and a second end, and a third support bracket attached to said first end of said third tube and attached to said first end of said fourth tube, said third support bracket maintaining said third tube and said fourth tube in spaced apart parallel position at said first predetermined distance, and wherein said second end of said third tube is movably positioned within said second end of said first tube and said second end of said fourth tube is movably positioned within said second end of said second tube;

a swivel arm bracket attached to said first tube and said second tube near said second ends of said first and second tubes and extending outward from beneath said first tube and said second tube;

a first swivel arm having a proximal end and a distal end and pivotally attached to said swivel arm bracket at the proximal end of said first swivel arm and extending substantially perpendicularly outward from said first tube, said first swivel arm including a first hinge attached to the distal end of said first swivel arm;

a second swivel arm having a proximal end and a distal end and pivotally attached to said swivel arm bracket at the proximal end of said second swivel arm and extending substantially perpendicularly outward from said second tube, said second swivel arm including a second hinge attached to the distal end of said second swivel arm;

a first clutch bearing having an inner race and an outer race, and wherein the inner race of said first clutch bearing is attached to said first hinge;

a second clutch bearing having an inner race and an outer race, and wherein said inner race of said second clutch bearing is attached to said second hinge;

first brake means positioned in contact with said outer race of said first clutch bearing, said first brake means creating a frictional resistive force with said outer race of said first clutch bearing;

second brake means positioned in contact with said outer race of said second clutch bearing, said second brake means creating a frictional resistive force with said outer race of said second clutch bearing;

a first oar arm attached to said first brake means;

a second oar arm attached to said second brake means;

a seat bracket including a horizontal planar member, a first pair of rollers and a second pair of rollers rotatably mounted to the underside of said planar member, wherein said first pair of rollers are spaced apart said first predetermined distance from said second pair of rollers, and said first and said second pair of rollers having a surface profile adapted to engage said first and said second tubes, and wherein said seat bracket is situated so that said first pair of rollers engages and rests upon said first tube and said second pair of rollers engages and rests upon said second tube;

a seat cushion attached to said horizontal planar member;

a horizontal foot rest attached to said third support bracket;

and wherein said first swivel arm and said second swivel arm are positionable in one of two positions, the first position being substantially perpendicular to the direction of said first and second tubes, the second position being substantially parallel to said first and second tubes.

9. The rowing machine of claim 8 wherein said first brake means is a first band brake encircling said first clutch bearing and applying a frictional force to said outer race of said first clutch bearing and said second brake means is a second band brake encircling said second clutch bearing and applying a frictional force to said outer race of said second clutch bearing.

10. The rowing machine of claim 9 wherein said first band brake includes a first brake force adjustment means for varying the frictional force between said first band brake and said outer race of said first clutch bearing, and wherein said second band brake includes a second brake force adjustment means for varying the frictional force between said second band brake and said outer race of said second clutch bearing.

11. The rowing machine of claim 10 wherein said first hinge includes a cylindrical portion adapted to fixedly receive the inner race of said first clutch bearing, and wherein said second hinge includes a cylindrical portion adapted to fixedly receive the inner race of said second clutch bearing.

12. The rowing machine of claim 11 including a frame locking means for engaging said frame and said frame extension to lock the position of said third tube and said fourth tube in relation to said first tube and said second tube.

13. A portable rowing machine comprising:

a frame including a first tube having a first end and a second end, a second tube having a first end and a second end, a first support bracket attached to said first tube and said second tube near said first end of said first and second tubes, and a second support bracket attached to said first tube and said second tube at a location between said first end and said second end of said first tube and said second tube and spaced apart from said first support bracket, said first support bracket and said second support bracket maintaining said first tube and said second tube in a horizontal parallel relationship at a first predetermined distance;

an arm bracket attached to said first tube and said second tube at a location between said first and said second support brackets;

a first arm having a proximal end and a distal end and attached to said arm bracket at the proximal end of said first arm and extending substantially perpendicularly outward from said first tube, said first arm including a first hinge attached to the distal end of said first arm;

a second arm having a proximal end and a distal end and attached to said arm bracket at the proximal end of said second swivel arm and extending substantially perpendicularly outward from said second tube, said second arm including a second hinge attached to the distal end of said second arm;

a first clutch bearing having an inner race and an outer race, and wherein the inner race of said first clutch bearing is attached to said first hinge;

a second clutch bearing having an inner race and an outer race, and wherein said inner race of said second clutch bearing is attached to said second hinge;

first brake means positioned in contact with said outer race of said first clutch bearing, said first brake means creating a frictional resistive force with said outer race of said first clutch bearing;

second brake means positioned in contact with said outer race of said second clutch bearing, said second brake means creating a frictional resistive force with said outer race of said second clutch bearing;

a first oar arm attached to said first brake means;

a second oar arm attached to said second brake means;

a seat bracket including a horizontal planar member, a first pair of rollers and a second pair of rollers rotatably mounted to the underside of said planar member, wherein said first pair of rollers are spaced apart said first predetermined distance from said second pair of rollers, and said first and said second pair of rollers having a surface profile adapted to engage said first and said second tubes, and wherein said seat bracket is situated so that said first pair of rollers engages and rests upon said first tube and said second pair of rollers engages and rests upon said second tube;

a seat cushion attached to said horizontal planar member; and a horizontal foot rest attached to said second support bracket.

14. The rowing machine of claim 13 wherein said first brake means is a first band brake encircling said first clutch bearing and applying a frictional force to said outer race of said first clutch bearing and said second brake means is a second band brake encircling said second clutch bearing and applying a frictional force to said outer race of said second clutch bearing.

15. The rowing machine of claim 14 wherein said first arm and said second arm are pivotally attached to said arm bracket and wherein said first and said second arms are positionable in one of two positions, the first position being substantially perpendicular to the direction of said first and second tubes, the second position being substantially parallel to said first and second tubes.

16. The rowing machine of claim 15 wherein said first tube and said second tube are telescoping tube assemblies and the length of said first tube and said second tube is adjustable over a predetermined distance range.

* * * * *